US006110357A

United States Patent [19]

Senn et al.

[11] Patent Number: 6,110,357

[45] Date of Patent: Aug. 29, 2000

[54] PASSIVATED CATALYSTS FOR CRACKING PROCESS

[75] Inventors: Dwayne R. Senn; Lyle R. Kallenbach; Brent J. Bertus, all of Bartlesville, Okla.

[73] Assignee: Phillips Petroleum Company, Bartlesville, Okla.

[21] Appl. No.: 08/314,471

[22] Filed: Sep. 28, 1994

[51] Int. Cl.[7] ..... C10G 11/02; C10G 11/05

[52] U.S. Cl. ..... 208/120.01; 208/113; 208/114; 502/521

[58] Field of Search ..... 502/521; 208/52 CT, 208/113, 114, 120, 120.01, 120.1, 120.2

[56] References Cited

U.S. PATENT DOCUMENTS

| | | | |
|---|---|---|---|
| 3,711,422 | 1/1973 | Johnson et al. | 252/414 |
| 4,178,267 | 12/1979 | McKay | 502/521 |
| 4,190,552 | 2/1980 | Bertus et al. | 502/521 |
| 4,192,770 | 3/1980 | Singleton | 252/414 |
| 4,193,891 | 3/1980 | McKay | 502/521 |
| 4,238,362 | 12/1980 | Bertus et al. | 502/521 |
| 4,295,955 | 10/1981 | Tu | 208/120 |
| 4,424,116 | 1/1984 | Hettinger, Jr. | 208/113 |
| 4,432,890 | 2/1984 | Beck et al. | 502/62 |
| 4,437,981 | 3/1984 | Kovach | 208/253 |
| 4,495,064 | 1/1985 | Boston | 502/521 |
| 4,496,665 | 1/1985 | Hettinger, Jr. et al. | 502/521 |
| 4,624,936 | 11/1986 | Sato et al. | 502/65 |
| 4,954,244 | 9/1990 | Fu et al. | 208/120 |
| 5,378,349 | 1/1995 | Senn | 502/521 |

*Primary Examiner*—Walter D. Griffin
*Attorney, Agent, or Firm*—Gary L. Haag

[57] ABSTRACT

A zeolite-containing cracking catalyst is passivated with compounds of boron and zirconium, and preferably also antimony. The thus-passivated cracking catalyst is employed in a process for catalytically cracking a hydrocarbon-containing oil feed. In another embodiment, compounds of boron and zirconium, and preferably also antimony, are added to a hydrocarbon-containing oil feed which is catalytically cracked in the presence of a zeolite-containing cracking catalyst.

12 Claims, No Drawings

PASSIVATED CATALYSTS FOR CRACKING PROCESS

BACKGROUND OF THE INVENTION

In one aspect, this invention relates to the treatment of catalytic cracking catalysts with at least two compounds which are effective metals passivating agents (so as to alleviate detrimental effects of metal deposits on the catalysts). In another aspect, this invention relates to the use of thus-treated catalysts in a catalytic cracking processes. In a further aspect, this invention relates to a process for catalytically cracking metal-containing oils wherein at least two compounds have been added to the oils so as to enhance the yields of desired products.

The treatment of metal-contaminated zeolite-containing cracking catalysts with "metals passivating agents" (for enhancing or restoring the activity of these catalyst and/or to increase the yields of desirable products, e.g., gasoline, and/or to reduce the production of undesirable products, e.g., hydrogen gas or heavy cycle oil, when these catalysts are employed in catalytic oil cracking processes) is well known and has been described in the patent literature (e.g., in U.S. Pat. Nos. 3,711,422 and 4,025,458). Also described in the patent literature (e.g., in U.S. Pat. No. 4,183,803) are processes for catalytically cracking heavy oils to which a metals passivation agent has been added as a passivating agent. The present invention is directed to the use of new metals passivating agents.

SUMMARY OF THE INVENTION

It is an object of this invention to provide a method of treating zeolite-containing cracking catalysts with at least two compounds so as to improve the catalytic cracking performance of these catalysts. It is another object of this invention to provide catalytic cracking processes which employs the above-treated (passivated) cracking catalysts. It is a further object of this invention to carry out catalytic cracking processes with metal-contaminated oil feeds to which at least two compounds, which are effective as metals passivating agents, have been added. The use of these metals passivating agents in the present invention results in benefits attained during catalytic cracking, in particular higher motor fuel yields (especially higher gasoline yield) and/or higher isobutane yield. Other objects and advantages will become apparent from the detailed description of the invention and the appended claims.

In accordance with this invention, a zeolite-containing catalytic cracking catalyst is contacted with at least one boron compound and at least one zirconium compound so as to provide a passivated catalyst, wherein at least about 0.005 weight percent boron and at least about 0.01 weight percent of zirconium have been incorporated into said passivated catalytic cracking catalyst. In a preferred embodiment, at least one antimony compounds is also incorporated into the catalyst (i.e., in addition to the boron and zirconium compounds).

Also in accordance with this invention, there is provided a passivated zeolite-containing catalytic cracking catalyst into which at least about 0.005 weight percent boron and at least about 0.01 weight percent of zirconium have been incorporated (by the passivation method described above). Preferably, at least about 0.01 weight-% antimony has also been incorporated into the catalyst.

Further in accordance with this invention, there is provided a process for catalytically cracking a hydrocarbon-containing oil feed, substantially in the absence of added hydrogen gas, in the presence of a passivated zeolite-containing catalytic cracking catalyst into which at least about 0.005 weight percent boron and at least about 0.01 weight percent zirconium have been incorporated (by the passivation method described above). Preferably, at least about 0.01 weight-% antimony has also been incorporated into the catalyst.

Still further in accordance with this invention, there is provided a process for catalytically cracking a hydrocarbon-containing oil feed, substantially in the absence of added hydrogen gas, in the presence of a zeolite-containing catalytic cracking catalyst in a catalytic cracking zone, wherein an effective amount of at least one boron compound and an effective amount of at least one zirconium compound are added to said oil feed so as to incorporate at least about 0.005 weight percent boron and at least about 0.01 weight-% zirconium into said catalytic cracking catalyst in the catalytic cracking zone. Preferably, at least one antimony compound is also added (i.e., in addition to the boron and zirconium compounds) to the oil feed so as to additionally incorporate at least about 0.01 weight-% antimony into said catalytic cracking catalyst in the catalytic cracking zone.

DETAILED DESCRIPTION OF THE INVENTION

Any zeolite-containing catalytic cracking catalyst can be used in the processes of this invention. The catalytic cracking catalyst can be a fresh (i.e., unused) material or a "spent" material (i.e., having been used in a previous process for catalytically cracking a hydrocarbon-containing oil which generally contains Ni, V and possibly other metal impurities, and having been regenerated by stream-stripping and coke burn-off) or an "equilibrium catalyst" material (i.e., a mixture of "spent" and fresh catalyst material, generally containing about 90–95 weight-% of "spent" catalyst). These equilibrium catalysts frequently contain about 0.01–1.0 weight-% Ni, about 0.01–1.0 weight-% V, and possibly other metal impurities (e.g., compounds of Fe, Cu, Na).

The zeolite component of the cracking catalyst composition can be any natural or synthetic crystalline aluminosilicate zeolite which exhibits cracking activity. Non-limiting examples of such zeolites are faujasite, chabazite, mordenite, offretite, erionite, Zeolon, zeolite X, zeolite Y, zeolite L, zeolite ZSM-4, zeolite ZSM-5, zeolite ZSM-11, zeolite ZSM-12, zeolite ZSM-23, zeolite ZSM-35, zeolite ZSM-38, zeolite ZSM-48, and the like, and mixtures thereof. Additional examples of suitable zeolites are listed in U.S. Pat. No. 4,158,621. The term "zeolite", as used herein, includes zeolites which have been pretreated, such as those from which a portion of Al has been removed from the crystalline framework, and zeolites which have been ion-exchanged with rare earth metal or ammonium or by other conventional ion-exchange methods. The term "zeolite", as used herein, also includes essentially aluminum-free silica polymorphs, such as silicalite, chromia-silicates, ferrosilicates, borosilicates, and the like, as disclosed in U.S. Pat. No. 4,556,749.

Generally, the zeolite component of the catalytic cracking catalyst composition is embedded in a suitable solid refractory inorganic matrix material, such as alumina, silica, silica-alumina (presently preferred), clay, aluminum phosphate, magnesium oxide, mixtures of two or more of the above-listed materials, and the like. The preparation of such zeolite/matrix cracking catalyst compositions is well known and is not a critical feature of this invention. Generally, the surface area (measured by nitrogen adsorption, substantially in accordance with the BET method of Brunauer, Emmett and Teller) of the zeolite/matrix cracking catalyst composition is in the range of from about 50 to about 800 $m^2/g$. Generally, the weight ratio of zeolite to matrix material in the catalytic cracking catalyst composition is in the range of from about 1:20 to about 1:1. The catalytic cracking catalyst composition comprising zeolite and matrix material can have any suitable particle size, and generally is coarser than about 200 mesh. The catalyst composition can be an extrudate or a pelletized material or an irregularly shaped material (depending on the particular type of cracking operation in which it is to be used).

The contacting of the zeolite-containing catalytic cracking catalyst with boron compound(s) and zirconium compound(s) in accordance with the first embodiment of this invention can be carried out in any suitable manner. In one mode of operation, the cracking catalyst is contacted in any suitable manner (preferably by impregnation or by spraying) with a solution (or, alternatively, colloidal dispersion) which contains boron compound(s) and zirconium compound(s). In a preferred embodiment, the solution additionally contains antimony compound(s). These compounds are generally dissolved in a suitable solvent (which may be a normally liquid hydrocarbon or water or any other liquid which dissolves a sufficient amount of these compounds). It is within the scope of this invention to employ treating agents in which the boron and zirconium compounds, and preferably also at least one antimony compound, are colloidally dispersed in a liquid.

In another mode of operation, a first solution (or, alternatively, colloidal dispersion) containing B compound (s) and a second solution (or, alternatively, colloidal dispersion) containing Zr compound(s) are prepared, and the catalyst composition is then contacted with the first solution (or colloidal dispersion) and thereafter with the second solution (or colloidal dispersion), either by impregnation or by spraying or by any other suitable contacting means. Or the catalyst composition is contacted with the second solution (or colloidal dispersion) and thereafter with the first solution (or colloidal dispersion), either by impregnation or by spraying or by any other suitable means. Or the catalyst composition is substantially simultaneously contacted (preferably by spraying) with the first solution (or colloidal dispersion) and the second solution (or colloidal dispersion). In another preferred mode of operation, a third solution (or alternatively, colloidal dispersions) containing Sb compound(s) is also prepared, and the catalyst is contacted (as described above) sequentially in any order with the first, second and third solutions (or, alternatively, suspensions), or substantially simultaneously contacted (preferably by spraying) with the first, second and third solutions (or, alternatively, colloidal dispersions).

Any suitable concentration of boron and zirconium, and optionally (preferably) also antimony, in the treating agents (i.e., either solutions or colloidal dispersions of the above-described compounds) can be employed. Generally, the treating agents (herein also referred to as passivating agents) contain about 0.01–0.5 mol/l B and about 0.01–0.5 mol/l Zr, and preferably also about 0.01–0.5 mole/l Sb. Alternatively, the treating agents contain about 0.01–0.5 mol/l (B+Zr), or about 0.01–0.5 mole/l (B+Zr+Sb). Any suitable weight ratio of at least one dissolved (or colloidally dispersed) boron compound to the catalyst composition can be applied. Generally, the weight ratio of boron compound(s) to the cracking catalyst is such as to provide a level of about 0.005–5 weight-% (preferably about 0.01–1 weight-%) boron in the passivated catalyst. Also, any suitable weight ratio of at least one zirconium compound to the cracking catalyst composition can be applied. Generally, the weight ratio of zirconium compound(s) to the cracking catalyst is such as to provide a level of about 0.01–5 weight-% (preferably about 0.02–1 weight-%) of zirconium in the passivated catalyst. If antimony is also to be added to the cracking catalyst, the weight ratio of antimony compound(s) to the cracking catalyst is such as to provide a level of about 0.01–5 weight-% (preferably about 0.02–1 weight-%) of antimony in the passivated catalyst. It is understood that the cracking catalyst to be passivated may already contain some Sb and Zr, and preferably also Sb (because it is a "spent" catalyst or an "equilibrium" catalyst which has undergone a previous passivation). In this case, the incorporation of smaller amounts of B and Zr, and preferably also Sb, in the present passivation process is required to attain the above-recited levels of B and of Zr and Sb in the passivated catalyst.

Any suitable boron compound can be employed as the first treating agent. Non-limiting examples of suitable B compounds are described in various patents (e.g., U.S. Pat. Nos. 4,192,770 and 4,295,955). Preferred boron compounds are triethyl borate, tripropyl borate, tributyl borate, tricyclohexyl borate, dibutyl phenyl borate, triphenyl borate, diborane, boric acid, ammonium diborate, sodium tetraborate (borax) and the like and mixtures thereof. The presently preferred boron compound is boric acid.

Any suitable zirconium compound can be employed as the second treating agent. Non-limiting examples of suitable Zr compounds are those described in U.S. Pat. No. 4,424,116 (column 24) and include zirconium tetraisopropoxide and other zirconium alcoholates, zirconium (IV) acetylacetonate (also referred to as zirconium tetra-2,4-pentanedionate), zirconium(IV) nitrate, zirconium(IV) sulfate or oxysulfate, zirconium(IV) acetate and other zirconium(IV) carboxylates, zirconium phenolates, zirconium naphthenates, and mixtures thereof. Zirconium(IV) acetylacetonate is the presently preferred Zr additive. These zirconium compounds are generally applied as solutions wherein the solvents are frequently polar organic solvents or liquid hydrocarbons.

Any suitable antimony compound can be employed as the first treating agent. Non-limiting examples of suitable Sb compounds are described in various patents (e.g., U.S. Pat. Nos. 3,711,422, 4,025,458, 4,190,552, 4,193,891, 4,263,131, among others). Preferred antimony compounds are antimony hydroxyhydrocarbylthiolates, such as antimony tris(2-hydroxyethylthiolate), antimony tris(0,0-dihydrocarbyl)phosphorodithiolates, antimony oxides (more preferably $Sb_2O_5$), antimony carboxylates, antimony mercaptides, and mixtures thereof. Presently preferred is antimony tris(2-hydroxyethylthiolate) dissolved in an organic solvent (more preferably 2-hydroxyethyl mercaptan, also referred to as 2-hydroxyethanethiol).

The thus-treated (passivated) catalytic cracking catalyst composition (now containing B and Zr, and preferably also Sb) is generally dried, preferably at about 80°–120° C. for about 0.5–10 hours, and frequently also calcined, preferably at about 500–800° C. for about 0.5–8 hours (in air or in an inert gas atmosphere, with or without added steam). If the contacting of the catalytic cracking catalyst composition with the liquid passivating solution (or, alternatively, colloidal dispersion) is carried out with a hot catalyst composition (generally having a temperature of about 400–700° C., e.g., one which is present in or exits from the oxidative regenerator of a catalytic cracking unit), separate heating (i.e., drying, calcining) steps can be omitted, because the drying occurs immediately after the contacting of the passivating agent(s) and the hot catalyst. Thus, it is within the scope of this invention to have the contacting and drying steps occur substantially simultaneously.

The catalytic cracking catalyst composition which has been contacted (passivated) with boron and zirconium compounds, and preferably also with antimony compound (s), in accordance with this invention can be used in any catalytic cracking process, i.e., a process for catalytically cracking hydrocarbon-containing oil feedstocks, in any suitable cracking reactor (e.g., in a FCC reactor or in a Thermofor moving bed reactor). The term "catalytic cracking", as used herein, implies that essentially no hydrocracking occurs and that the catalytic cracking process is carried out with a hydrocarbon-containing oil feed substantially in the absence of added hydrogen gas, under such conditions as to obtain at least one liquid product stream having a higher API gravity (measured at 60° F.) than the feed. The treated catalyst composition can be used alone or in admixture with fresh (unused) zeolite-containing catalyst composition in catalytic cracking processes.

The hydrocarbon-containing feed stream for the catalytic cracking process of this invention can be any suitable feedstock. Generally, the feed has an initial boiling point (ASTM D1160) of at least about 400° F., and preferably has a boiling range of from about 400° F. to about 1200° F., more preferably a boiling range of about 500° F. to about 1100° F., measured at atmospheric pressure conditions. Generally, this feed contains metal impurities, particularly nickel and vanadium compounds (generally in excess of about 0.01 ppm Ni and in excess of about 0.01 ppm V). The API gravity (measured at 60° F.) generally is in the range of from about 5 to about 40, preferably from about 10 to about 35. Generally, these feedstocks contain Ramsbottom carbon residue (ASTM D524; usually about 0.1–20 weight-%), sulfur (generally about 0.1–5 weight-% S), nitrogen (generally about 0.05–2 weight-% N), nickel (generally about 0.05–30 ppm Ni, i.e., about 0.05–30 parts by weight of Ni per million parts by weight of oil feed) and vanadium (generally about 0.1–50 ppm V, i.e., about 0.1–50 parts by weight of vanadium per million parts by weight of oil feed). Small amounts (generally about 0.01–50 ppm) of other metal impurities, such as compounds of Cu, Na, and Fe may also be present in the oil feed. Non-limiting examples of suitable feedstocks are light gas oils, heavy gas oils, vacuum gas oils, cracker recycle oils (light cycle oils and heavy cycle oils), residua (such as distillation bottoms fractions), and hydrotreated residua (e.g., hydrotreated in the presence of Ni, Co, Mo-promoted alumina catalysts), liquid coal pyrolyzates, liquid products from the extraction or pyrolysis of tar sand, shale oils, heavy fractions of shale oils, and the like. The presently most preferred feedstocks are heavy gas oils and hydrotreated residua.

Any suitable reactor can be used for the catalytic cracking process of this invention. Generally, a fluidized-bed catalytic cracking (FCC) reactor (preferably containing one or more risers) or a moving-bed catalytic cracking reactor (e.g., a Thermofor catalytic cracker) is employed. Preferably, the reactor is a FCC riser cracking unit. Examples of such FCC cracking units are described in U.S. Pat. Nos. 4,377,470 and 4,424,116. Generally a catalyst regeneration unit (for removal of coke deposits) is combined with the FCC cracking unit, as is shown in the above-cited patents.

Specific operating conditions of the cracking operation greatly depend on the type of feedstock, the type and dimensions of the cracking reactor and the oil feed rate. Examples of operating conditions are described in the above-cited patents and in any other publications. In an FCC operation, generally the weight ratio of catalyst composition to oil feed (i.e., hydrocarbon-containing feed) ranges from about 2:1 to about 10:1, the contact time between oil feed and catalyst is in the range of from about 0.2 to about 2.0 seconds, and the cracking temperature is in the range of from about 800° to about 1200° F. Generally, steam is added with the oil feed to the FCC reactor so as to aid in the dispersion of the oil as droplets. Generally, the weight ratio of steam to oil feed is in the range of from about 0.05:1 to about 0.5:1.

The separation of the thus employed cracking catalyst composition from gaseous and liquid cracked products (in particular hydrocarbons) and the separation of cracked products into various gaseous and liquid product fractions can be carried out by any well known, conventional separation means. The most desirable product fraction is gasoline (ASTM boiling range: about 80–400° F.). Non-limiting examples of such separation schemes are showing in "Petroleum Refining" by James H. Gary and Glenn E. Handwerk, Marcel Dekker, Inc., 1975.

Generally, the used cracking catalyst composition which has been separated from cracked gaseous and liquid products (e.g., in a cyclone) is then regenerated, preferably by steam-stripping for removal of adhered oil and by subsequent heating under oxidizing conditions so as to burn off carbon deposits by conventional means. At least a portion of the regenerated cracking catalyst composition can then be treated by the catalyst treating process of this invention, described above. Thereafter, the regenerated and passivated catalyst is recycled to the catalytic cracking reactor, generally in admixture with fresh (unused) cracking catalyst.

In one preferred embodiment of this invention, the passivating agents (i.e., at least one boron compound and at least one zirconium compound, and optionally also at least one antimony compound) are added to the hydrocarbon-containing oil feed stream before it enters the catalytic cracking reactor. The passivating agents are injected either directly into the oil feed or into a slurry oil recycle stream (the highest boiling fraction of cracked products, generally containing dispersed catalyst fines) which is then combined with fresh oil feed. The cracking catalyst comes in contact with the oil feed in the cracking zone where B and Zr, and preferably also Sb, are absorbed by and incorporated into the catalyst, thus providing a passivated catalyst in the cracking zone. The employed metal concentrations of the passivating solutions (or, alternatively, colloidal dispersion) and their injection rates are dependent on the metal contaminant content of the feed, but are generally chosen such that at least about 0.005 weight-% B and at least about 0.01 weight-% of Zr, and preferably also at least about 0.01 weight-% Sb, are incorporated into the catalyst in the cracking zone. Generally, the passivated cracking catalyst, when it is present in the cracking zone after it has been brought into contact with the passivating agent(s), contains about 0.005 to about 5 weight-% (preferably about 0.01–1 weight-%) B and about 0.01 to about 5 weight-% (preferably about 0.02–1 weight-%) Zr, and preferably also about 0.01 to about 5 weight-% (preferably about 0.02–1 weight-%) Sb. Generally, the concentration of added boron (on an elemental basis) in the oil feed is about 0.1–5,000 ppm B, and the concentration of added zirconium (on an elemental basis) in the oil feed is about 0.1–5,000 ppm Zr. If antimony is also added, its concentration in the oil is about 0.1–5,000 ppm Sb (on an elemental basis). In another (presently less preferred) embodiment, the passivating agent(s) can be injected directly into the catalytic cracking reactor, at such an amount and rate as to provide the above-recited levels of B and of Zr and, preferably also Sb, in the catalyst. It is, of course, within the scope of this invention to add compounds of Sb and Zr, and preferably also Sb, compounds to the oil feed and also employ a zeolite-containing cracking catalyst which already contains some B and Zr, and preferably also Sb (because the catalyst is a "spent" or "equilibrium" catalyst which has previously undergone passivation). In this latter case, the amounts of compounds of B and Zr, and preferably also Sb, which are injected into the feed are adjusted such that the above-recited levels of B and Zr, and preferably also Sb, in the passivated catalyst in the cracking zone are attained.

In a further preferred embodiment, at least one passivating solution (or colloidal dispersion) described above is injected into the oxidative regenerator (described above) so that the liquid treating agent(s) come in contact with the hot spent catalyst which results in the deposition of compounds of B and Zr, and preferably also Sb, contained in the solution (or colloidal dispersion) on the catalyst and in substantial simultaneous drying/calcining of the passivated catalyst. The at least one passivating solution (or colloidal dispersion) is injected into the regenerator at such a rate as to provide the above-specified levels of B and Zr, and preferably also Sb, in the regenerated cracking catalyst composition. It is also within the scope of this invention to inject the liquid treating agent(s) into conduits transporting hot "spent" catalyst to or from the regenerator. The thus-treated regenerated catalytic cracking catalyst composition can then be recycled, optionally admixed with fresh (treated or untreated) cracking catalyst composition, to the catalytic cracking zone.

The following examples are presented to further illustrate this invention and are not to be considered as unduly limiting the scope of this invention.

EXAMPLE I

This example illustrates the treatment of a nickel-containing catalytic cracking catalyst with boron and zirconium compound(s) and the use of the thus-treated catalysts for catalytic cracking.

Catalyst A (Control) was a regenerated equilibrium cracking catalyst obtained from a FCC unit of a refinery of Phillips Petroleum Company. This catalyst contained about 12 weight-% zeolite having a unit cell size of 24.29 angstroms and about 88 weight-% silica-alumina binder material. Catalyst A had a total surface area of 171 $m^2/g$, and contained about 800 ppm Ni and about 900 ppm V as impurities (from the previous use in a commercial catalytic cracking operation).

Catalyst B (Control) contained 200 ppm boron, and was prepared by impregnating 50.0 g Catalyst A with a solution of 0.0572 g $H_3BO_3$ (boric acid) in 30 mL methanol. The B-impregnated catalyst was dried, calcined for 1 hour at 1250° F. in air, and then treated in 11 sequential oxidational reduction cycles (which simulated aging of catalytic cracking catalysts in commercial cracking/regeneration operations), wherein each oxidation/reduction cycle was carried out as follows: heating the catalyst to 1300° F. in a nitrogen gas atmosphere over a period of 1.1 minute, maintaining this temperature for 3 minutes while passing nitrogen gas over the catalyst, heating the catalyst in an air stream at 1300° F. for 16 minutes, purging the catalyst with nitrogen gas at 1300° F. for 4 minutes, and cooling the catalyst to 900° F. over a period of about 4 minutes in a stream of a hydrogen/nitrogen gas mixture (having an $H_2$:$N_2$ volume ratio of 2:1).

Catalyst C (Control) contained 1200 ppm Zr, and was prepared by impregnating 50.0 g Catalyst A with a solution of 0.3207 g Zr(IV) acetylacetonate solution (containing 18.7 weight-% Zr; available for Alpha Chemical Company, Ward Hill, Mass.) in 30 mL methanol. The Zr-impregnated catalyst was dried and calcined (as described for Catalyst B), and then underwent 11 oxidation/reduction cycles (as described for Catalyst B).

Catalyst D (Invention) contained 200 ppm B and 1200 ppm Zr, and prepared by impregnating 50.0 g Catalyst A with a solution of 0.0572 g $H_3BO_3$ and 0.3207 g Zr(IV) acetylacetonate in 30 mL methanol. The B/Zr-impregnated catalyst was dried and calcined (as described for Catalyst B), and then underwent 11 oxidation/reduction cycles (as disclosed for Catalyst B).

Catalysts A–D were then evaluated in a laboratory MAT cracking test apparatus, substantially as described in ASTM Method D3907, employing a hydrotreated crude oil feed containing 5.4 weight-% Conradson carbon, 0.5 weight-% sulfur, 031 weight-% nitrogen, 1.6 weight-% n-pentane insolubles, 1.1 ppm Ni, 2.4 ppm V and 1.3 ppm Fe. The MAT tests were carried out at a catalyst:oil weight ratio of about 3: 1, a reaction temperature of 950° F., a reaction time of 75 seconds, a steam-stripping cycle of 10 minutes, and a regeneration cycle of 30 minutes at a temperature of 1250° F. Pertinent test results (averages of two measurements) are summarized in Table I. The product yields were calculated by dividing the weight of a particular product produced per hour by the weight of the oil feed which had been converted per hour.

TABLE I

| Catalyst | Catalyst Additive | % Feed Conversion | % Gasoline Yield | % Light Cycle Oil Yield | % Heavy Cycle Oil Yield | % Coke Yield | $H_2$ Yield (SCF/BF)[1] | $iC_4/nC_4$[2] | MFS[3] |
|---|---|---|---|---|---|---|---|---|---|
| A | — | 75.7 | 48.8 | 17.2 | 7.2 | 14.2 | 345 | 4.2 | 3.1 |
| B | 200 ppm B | 73.1 | 48.1 | 18.3 | 8.6 | 12.2 | 375 | 4.2 | 3.2 |
| C | 1200 ppm Zr | 74.6 | 49.2 | 17.5 | 8.0 | 12.0 | 319 | 4.1 | 3.3 |
| D | 200 ppm B + 1200 ppm Zr | 74.6 | 49.8 | 17.7 | 7.7 | 12.3 | 352 | 4.3 | 3.4 |

[1]Standard cubic feet $H_2$ per barrel feed oil
[2]Volume ratio of produced isobutane to produced n-butane
[3]Motor Fuel Selectivity: yield of (gasoline + light cycle oil) divided by yield of (heavy cycle oil + coke)
Note: All runs also produced 1.1–1.2 weight-% methane, about 0.6 weight-% ethylene, 0.8–0.9 weight-% ethane, 3.2–3.4 ewight-% propylene, about 0.9 weight-% propane, 2.6–2.9 weight-% butenes, 2.2–2.3 weight-% isobutane, and 0.5–0.6 weight-% n-butane.

Test data in Table I show that invention Catalyst D produced more motor fuels, especially gasoline, than any of the control catalysts (Catalysts A, B and C). Furthermore, the ratio of isobutane (a desirable alkylation feedstock) to n-butane was slightly higher in the test run which employed invention Catalyst D.

EXAMPLE II

This examples illustrates the treatment of a nickel/vanadium-contaminated FCC equilibrium cracking catalyst with boron, zirconium and antimony compounds, and the use of the thus-treated catalysts for catalytic cracking.

Catalyst E (Control) was prepared as follows. A calcined, fresh, zeolite-containing cracking catalyst (a commercial catalyst containing a zeolite having a unit cell size of about 24.57 angstroms and a silica-alumina binder material; having a total surface area of about 265 $m^2/g$; supplied by the Davison Chemical Division of W. R. Grace and Company, Baltimore, Md.) was impregnated at room temperature with a solution of nickel 2-ethylhexanoate in toluene (containing about 12.7 weight-% Ni; provided by Mooney Chemicals, Cleveland, Ohio) such as to incorporate about 2,400 ppm Ni into the catalyst, followed by drying the Ni-containing catalyst, calcining it for 1–2 hours at 1250° F. in air, treating it with 100% steam for 4 hours at 1425° F., and subjecting it to 14 oxidation/reduction cycles (described for Catalyst B). The thus-treated catalyst simulates a used cracking catalyst which had been contaminated with nickel.

Catalyst F (Control) contained 400 ppm B and 3600 ppm Sb, and was prepared by impregnating 50.0 g Catalyst E (containing 2,400 ppm Ni) with a solution of 0.1144 g $H_3BO_3$ and 0.8571 g Phil-Ad CA 3000 (a solution of antimony tris(2-hydroxyethylthiolate) in 2-hydroxyethanethiol containing about 21 weight-% Sb; provided by Catalyst Resources, Inc., Bayport, Tex.) in 30 mL methanol. The B/Sb-impregnated catalyst was dried, calcined and steam-treated (as described for Catalyst E), and then underwent 13 oxidation/reduction recycles (as described for Catalyst B).

Catalyst G (Control) contained 2700 ppm Zr and 3600 ppm Sb, and was prepared by impregnating 50.0 g Catalyst E (containing 2400 ppm Ni) with a solution of 0.8571 Phil-Ad CA (described above) in 30 mL acetone and then with a solution of 0.7215 g Zr(IV) acetylacetonate in 30 mL methanol. The Zr/Sb-impregnated catalyst was dried, calcined and steam-treated (as described for Catalyst E), and then subjected to 10 oxidation/reduction cycles (as described for Catalyst B).

Catalyst H (Invention) contained 400 ppm B, 2700 ppm Zr and 3600 ppm Sb, and was prepared by impregnating 50.0 g Catalyst E (containing 2400 ppm Ni) with a solution of 0.1144 g $H_3BO_3$, 0.7215 g Zr(IV) acetylacetonate and 0.8571 g of Phil-Ad CA (described above) in 30 mL methanol. The B/Zr/Sb-impregnated catalyst was dried, calcined and steam-treated (as described for Catalyst E), and was then subjected to 10 oxidation/reduction cycles (as described for Catalyst B).

Catalysts E-H were evaluated in a MAT cracking test apparatus according to the procedure described in Example I. Pertinent test results (averages of two measurements) are summarized in Table II.

| Catalyst | Catalyst Additive | % Feed Conversion | % Gasoline Yield | % Light Cycle Oil Yield | % Heavy Cycle Oil Yield | % Coke Yield | $H_2$ Yield (SCF/BF)[1] | $iC_4/nC_4$[2] | MFS[3] |
|---|---|---|---|---|---|---|---|---|---|
| E | — | 79.7 | 52.4 | 14.0 | 6.3 | 12.7 | 399 | 3.9 | 3.5 |
| F | 400 ppm B + 3600 ppm Sb | 79.0 | 53.7 | 14.4 | 6.7 | 11.7 | 318 | 3.9 | 3.7 |
| G | 2700 ppm Zr + 3600 ppm Sb | 79.1 | 56.1 | 14.1 | 6.8 | 10.2 | 220 | 4.0 | 4.1 |
| H | 400 ppm B + 2700 ppm Zr + 3600 ppm Sb | 77.7 | 53.8 | 20.7 | 1.7 | 11.2 | 319 | 4.1 | 5.8 |

[1]Standard cubic feet $H_2$ per barrel feed oil
[2]Volume ratio of produced isobutane to produced n-butane
[3]Motor Fuel Selectivity: yield of (gasoline + light cycle oil) divided by yield of (heavy cycle oil + coke)
Note: All tests also produced about 0.9 weight-% methane, 0.7–0.8 weight-% ethylene, 0.8–0.9 weight-% ethane, 3.5-3.6 weight-% propylene, 1.2–1.6 weight-% propane, 1.1–1.3 weight-% butenes, 3.2–4.0 weight-% isobutane, and 0.8–1.0 weight-% n-butane.

Test data in Table II show that the run employing invention Catalyst H produced motor fuels (gasoline and light cycle oil) at a higher selectivity than control runs employing Catalysts E-G. Also, the ratio of the more valuable isobutane to the less desirable n-butane was highest in the invention run employing Catalyst H.

Reasonable variations and modifications which will be apparent to those skilled in the art, can be made within the scope of the disclosure and appended claims without departing from the scope of this invention.

That which is claimed is:

1. In a process for catalytically cracking a hydrocarbon-containing oil feed, which contains in excess of about 0.01 ppm nickel and in excess of about 0.01 ppm vanadium and has an initial boiling point of at least about 400° F., substantially in the absence of added hydrogen gas, in the presence of a zeolite-containing catalytic cracking catalyst in a catalytic cracking zone at a temperature in the range of about 800–1200° F., wherein at least one zirconium compound and at least one antimony compound are added to said oil feed to as to provide a concentration of about 0.1–5,000 ppm added zirconium and about 0.1–5,000 ppm added antimony in said oil feed and to incorporate at least about 0.01 weight-% zirconium and at least about 0.01 weight-% antimony into said catalytic cracking catalyst in said catalytic cracking zone, the improvement which comprises additionally adding at least one boron compound to said oil feed so as to provide a concentration of about 0.1–5,000 ppm added boron in said oil feed and to additionally incorporate at least about 0.005 weight-% boron into said catalytic cracking catalyst in said catalytic cracking zone, thereby causing an increase of the combined yield of gasoline and light cycle oil produced in said process.

2. A process in accordance with claim 1, wherein said catalytic cracking catalyst comprises at least one zeolite embedded in a silica-alumina matrix material.

3. A process in accordance with claim 2, wherein said catalytic cracking catalyst comprises metal contaminants selected from the group consisting of nickel compounds and vanadium compounds.

4. A process in accordance with claim 2, wherein about 0.005–5 weight-% B, about 0.01–5 weight-% Zr and about 0.01–5 weight-% Sb have been incorporated into said catalytic cracking catalyst in said catalytic cracking zone.

5. A process in accordance with claim 1, wherein said oil feed has a boiling range of from about 400° F. to about 1200° F., and contains about 0.05–30 ppm nickel and about 0.1–50 ppm vanadium.

6. A process in accordance with claim 1, wherein the weight ratio of said catalytic cracking catalyst to said oil feed is in the range of about 2:1 to about 10:1.

7. In a process for catalytically cracking a hydrocarbon-containing oil feed, which contains in excess of about 0.01 ppm nickel and in excess of about 0.01 ppm vanadium and has an initial boiling point of at least of about 400° F., substantially in the absence of added hydrogen, in the presence of a zeolite-containing catalytic cracking catalyst in a catalytic cracking zone at a temperature of about 800–1200° F., wherein said zeolite-containing catalytic cracking catalyst is a passivated catalytic cracking catalyst which has been contacted, prior to said process, with at least one zirconium compound and at least one antimony compound and wherein at least about 0.01 weight-% zirconium and at least about 0.01 weight-% antimony have been incorporated into said passivated catalytic cracking catalyst, the improvement which comprises employing a passivated catalytic cracking catalyst which has additionally been contacted, prior to said process, with at least one boron compound and wherein at least about 0.005 weight-% boron has additionally been incorporated into said passivated cracking catalyst, thereby causing an increase of the combined yield of gasoline and light cycle oil produced in said process.

8. A process in accordance with claim 7, wherein said catalytic cracking catalyst comprises at least one zeolite embedded in a silica-alumina matrix material.

9. A process in accordance with claim 8, wherein said catalytic cracking catalyst comprises metal contaminants selected from the group consisting of nickel compounds and vanadium compounds.

10. A process in accordance with claim 8, wherein about 0.005–5 weight-% B, about 0.01–5 weight-% Zr and about 0.01–5 weight-% Sb have been incorporated into said passivated catalytic cracking catalyst.

11. A process in accordance with claim 7, wherein said oil feed has a boiling range of from about 400° F. to about 1200° F., and contains about 0.05–30 ppm nickel and about 0.1–50 ppm vanadium.

12. A process in accordance with claim 7, wherein the weight ratio of said catalytic cracking catalyst to said oil feed is in the range of about 2:1 to about 10:1.

* * * * *